US005498167A

United States Patent [19]

Seto et al.

[11] Patent Number: 5,498,167

[45] Date of Patent: Mar. 12, 1996

[54] BOARD TO BOARD ELECTRICAL CONNECTORS

[75] Inventors: Masashi Seto, Zama; Shinichi Aihara, Atsugi; Kouichi Inoue, Yokohama, all of Japan

[73] Assignee: Molex Incorporated, Lisle, Ill.

[21] Appl. No.: 310,533

[22] Filed: Sep. 22, 1994

[30] Foreign Application Priority Data

Apr. 13, 1994 [JP] Japan ..... 6-10505

[51] Int. Cl.[6] ..... H01R 9/09

[52] U.S. Cl. ..... 439/74; 439/284; 439/65

[58] Field of Search ..... 439/74, 78, 80, 439/284, 291, 293, 65, 569–570, 563, 857, 862

[56] References Cited

U.S. PATENT DOCUMENTS

| | | | |
|---|---|---|---|
| 4,317,609 | 3/1982 | Lapraik | 439/857 |
| 5,030,107 | 7/1991 | Moon . | |
| 5,098,311 | 3/1992 | Roath et al. | 439/291 |
| 5,112,235 | 5/1992 | Enomoto et al. | 439/857 |
| 5,116,247 | 5/1992 | Enomoto et al. | 439/660 |
| 5,161,985 | 11/1992 | Ramsey | 439/74 |
| 5,199,884 | 4/1993 | Kaufman et al. | 439/74 |
| 5,224,866 | 7/1993 | Nakamura et al. | 439/81 |
| 5,299,939 | 4/1994 | Walker et al. | 439/74 |
| 5,310,357 | 5/1994 | Olson | 439/346 |
| 5,376,009 | 12/1994 | Olsson et al. | 439/74 |

FOREIGN PATENT DOCUMENTS

| | | | |
|---|---|---|---|
| 2207467 | 8/1990 | Japan | H01R 13/28 |
| 499369 | 8/1992 | Japan | H01R 13/28 |

*Primary Examiner*—David L. Pirlot
*Assistant Examiner*—Jill DeMello
*Attorney, Agent, or Firm*—Stephen Z. Weiss

[57] ABSTRACT

A low profile hermaphroditic electrical connector is provided for mounting on the surface of a first printed circuit board and is adapted to mate with an identical second connector mounted on the surface of a second printed circuit board to electrically and mechanically couple the boards together. Each connector includes a housing mounting a plurality of stamped female and male terminals. Each terminal includes a surface mounting portion for electrically engaging the respective printed circuit board, a mating portion adapted to mate with the mating portion of the terminal of the opposite gender of the other hermaphroditic connector, and a portion for holding the terminal in the housing. The mating portion of the female terminal includes two opposed, spaced apart contact arms. The arms and the terminal holding portion both project from the mounting portion. The mating portion of the male terminal includes a contact post adapted to be received between the contact arms of the female terminal. The post and the terminal holding portion both project from the mounting portion. The male terminal includes a lip projecting beneath a shoulder on the housing to resist lifting of the surface mounting portion off the respective printed circuit board during unmating of the connectors.

12 Claims, 3 Drawing Sheets

BOARD TO BOARD ELECTRICAL CONNECTORS

FIELD OF THE INVENTION

This invention generally relates to the art of electrical connectors and, particularly, to electrical connectors for coupling first and second printed circuit boards together.

BACKGROUND OF THE INVENTION

A variety of electrical connectors have been used to make electrical connections between the circuits on different printed circuit boards. Typically, board to board connectors have both male and female portions or terminals to form an electrical connection between the two circuit boards. Male connector posts or pins typically are coupled to a first circuit board, and the male connector posts mate with female connector receptacles coupled to the second circuit board.

Board to board connector systems as described above often require two types of connectors to be maintained in inventory in order to afford coupling two printed circuit boards together. However, hermaphroditic connectors have been designed where two identical connectors can be mated to one another in a given orientation. Therefore, only one type of connector needs to be maintained in inventory.

Problems have been encountered with these types of electrical connector systems, because there is an increasing demand for high density connectors which also allow printed circuit boards to be placed closer together. A high density connector often requires the use of a stamped terminal to reduce the spacing between the terminals of a given connector. To allow printed circuit boards to be placed closer together in parallel planes, a very low profile board to board connector is required. These demands often result in relatively complicated connector designs.

The present invention is directed to providing a simple, efficient and inexpensive high density, low profile hermaphroditic board to board electrical connector which satisfies the needs of the connector industry as is not available in the prior art.

SUMMARY OF THE INVENTION

An object, therefore, of the invention is to provide a new and improved electrical connector of the character described above.

Another object of the invention is to provide a low profile hermaphroditic electrical connector mounted on the surface of a first printed circuit board and adapted to mate with an identical second connector mounted on the surface of a second printed circuit board to electrically and mechanically couple the first and second circuit boards.

In the exemplary embodiment of the invention, the connector includes a housing mounting a plurality of stamped female and male terminals. Each terminal has a surface mounting portion for electrically engaging the respective printed circuit board, a mating portion adapted to mate with the mating portion of the terminal of the opposite gender of the other hermaphroditic connector, and means for holding the terminals in the housing. The invention contemplates that the mating portion of the female terminal include two opposed, spaced apart contact arms. The contact arms and the terminal holding means both project from the mounting portion, with the contact arms laterally adjacent the terminal holding means. The mating portion of the male terminal includes a post adapted to be received between the contact arms of the female terminal. The post and the terminal holding means of the male terminal both project from the mounting portion, with the post laterally adjacent the terminal holding means.

As disclosed in the preferred embodiment, the surface mounting portion of the female terminal comprises an elongated generally planar base having opposed stamped edges. One edge is adapted for electrically engaging the respective printed circuit board. The contact arms and the terminal holding means both project from the opposite edge. The contact arms and the terminal holding means are generally planar and coplanar with the base. The terminal holding means is provided by a post generally parallel to the contact arms.

Similarly, the surface mounting portion of the male terminal comprises an elongated generally planar base having opposed stamped edges. One edge is adapted for electrically engaging the respective printed circuit board, and the post and terminal holding means both project from the opposite edge of the base. The post and the terminal holding means are generally planar and coplanar with the base. The terminal holding means is provided by a second post generally parallel to the male terminal post.

Another feature of the invention is to provide a lip projecting from the base portion of the male terminal beneath a shoulder on the respective housing. The lip is engageable with the shoulder to resist lifting of the surface mounting portion off the respective printed circuit board during unmating of the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
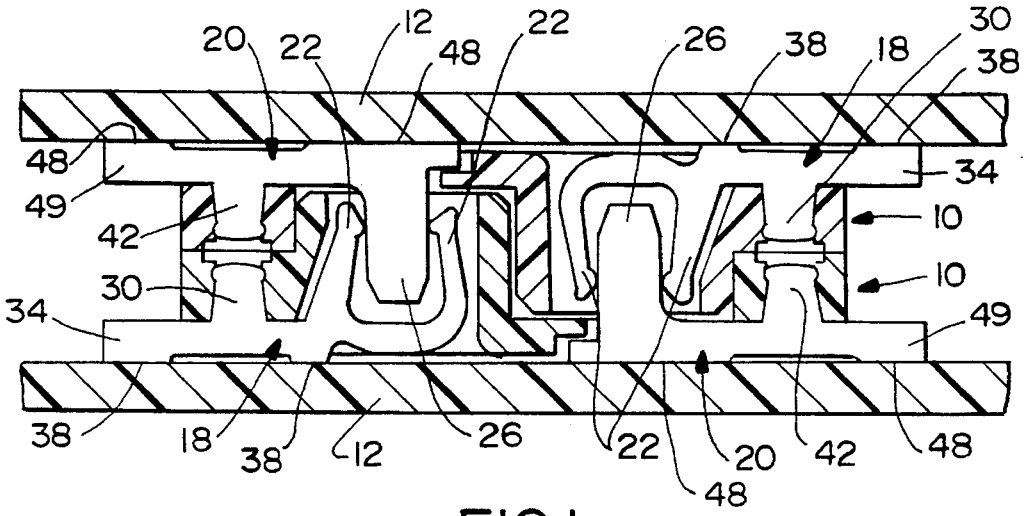
FIG. 1 is a vertical section through a pair of hermaphroditic electrical connectors embodying the concepts of the invention, the connectors being surface mounted to a pair of parallel printed circuit boards.
Figure 2:
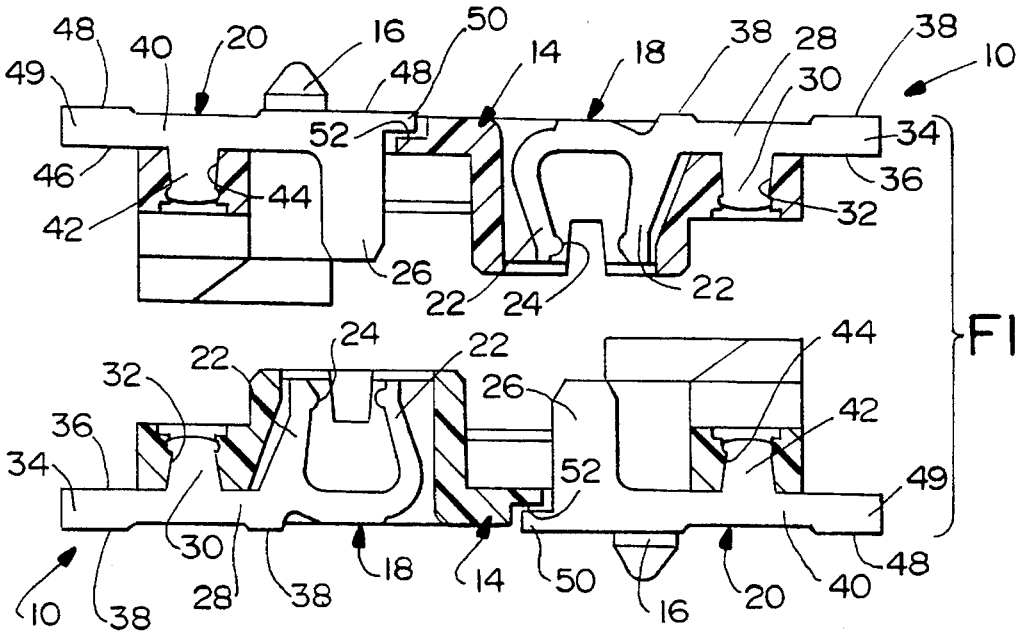
FIG. 2 is a vertical section through the two connectors of FIG. 1, with the connectors disconnected and the printed circuit boards removed.

Referring to the drawings in greater detail, and first to FIG. 1, the invention is embodied in a hermaphroditic electrical connector, generally designated 10. Two connectors 10 are identical in structure, and the connectors are shown in FIG. 1 fully mated and coupling a pair of printed circuit boards 12 together in a parallel orientation. FIG. 2 shows the two hermaphroditic connectors unmated, and with the circuit boards removed to facilitate the illustration.

More particularly, each hermaphroditic connector 10 includes a one-piece dielectric housing, generally designated 14, that may be unitarily molded of plastic material. A plurality of mounting posts 16 project from the housing for insertion into appropriate mounting holes in the respective circuit board. Each connector mounts a stamped female terminal, generally designated 18, and a stamped male terminal, generally designated 20. The female terminal includes a pair of generally parallel contact arms 22 which define a receptacle 24 therebetween for receiving a contact post 26 of male terminal 20.

Still referring to FIGS. 1 and 2, female terminal 18 is a stamped metal component with contact arms 22 which form a mating portion and project from one end of an elongated base 28. Terminal holding means in the form of a mounting post 30 projects in the same direction away from one edge 36 of base 28 as contact arms 22. The mounting post is interference fit within a mounting aperture 32 in housing 14 to hold female terminal 18 within the housing. An edge of the base opposite the one edge 36 is provided with a pair of surface mounting portions 38 for electrically coupling to appropriate circuit traces on the respective circuit board. The contact arms and the mounting post are generally planar and coplanar with base 28. Lastly, a terminal foot 34 projects laterally outwardly of the housing.

Male terminal 20 similarly includes an elongated base 40 with contact post 26 defining the mating portion of the terminal. A mounting post 42 projects from the base generally parallel to contact post 26. The mounting post is interference fit within a mounting aperture 44 in housing 14.

As with female terminal 18, male terminal 20 is a stamped metal component defining an edge 46 from which contact post 26 and mounting post 42 project. The opposite edge of the base defines a pair of surface mounting portions 48 for engaging appropriate circuit traces on the respective printed circuit board 12. The contact post and the mounting post are generally planar and coplanar with base 40. The male terminal includes a terminal foot 49 projecting laterally of housing 14 at the end of base 40 opposite contact post 26.

One or both of the female and male terminals 18 and 20, respectively, are provided with means for resisting lifting of the terminal off of its respective printed circuit board during unmating of the connectors. In the exemplary embodiment, male terminal 20 is provided with a lip 50 which projects laterally away from the contact end of base 40 beneath a shoulder 52 of housing 14. Therefore, upon unmating of the connectors, lip 50 can engage shoulder 52 to resist lifting of the surface mounting portions of the terminal off the respective printed circuit board.

Figure 3:
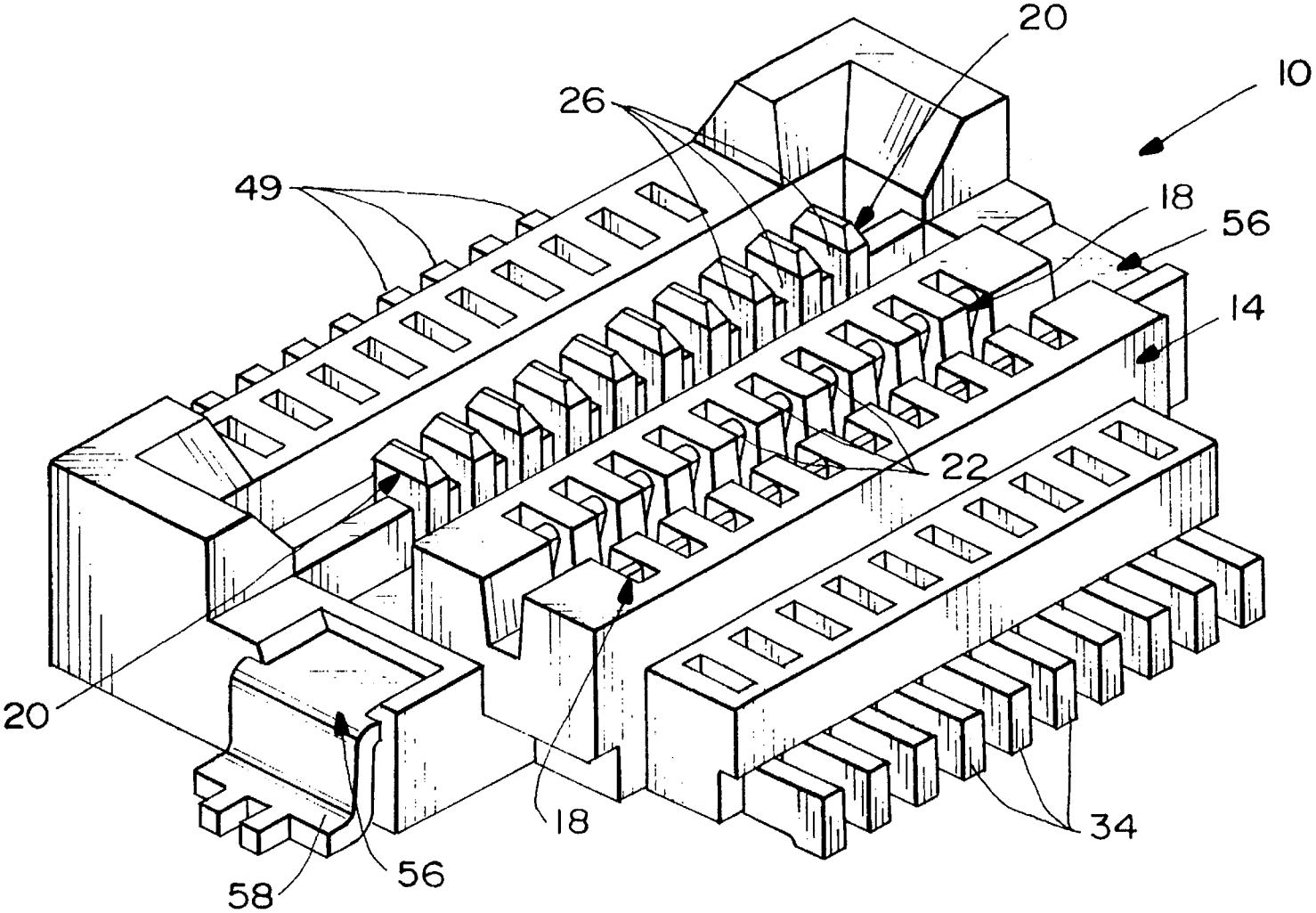
FIG. 3 is an elevated perspective view of one of the connectors.
Figure 4:
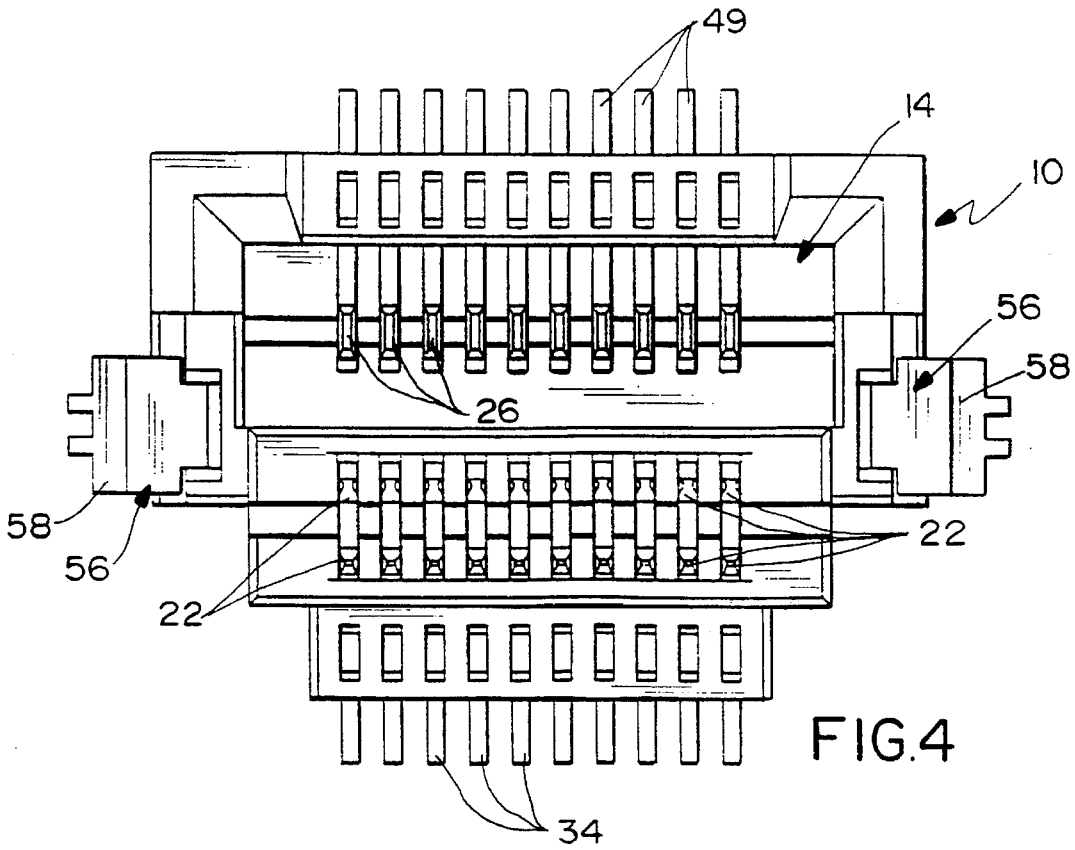
FIG. 4 is a top plan view of one of the connectors.
Figure 5:
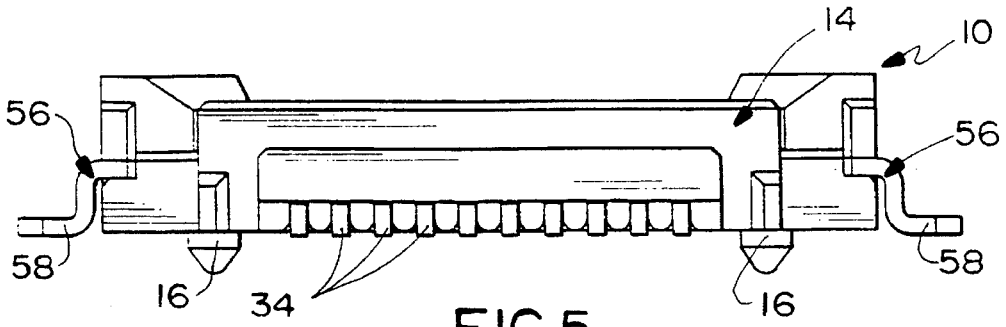
FIG. 5 is a side elevational view of one of the connectors.
Figure 6:
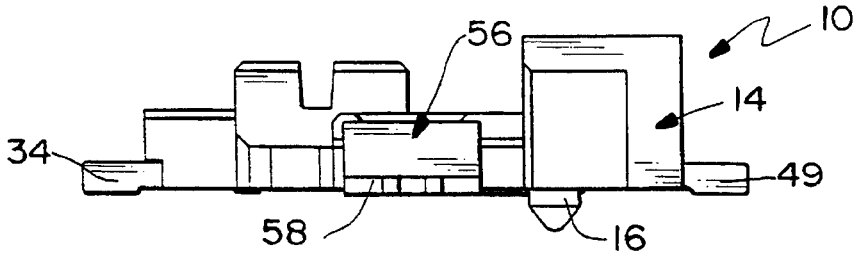
FIG. 6 is an end elevational view of one of the connectors.

FIG. 3 shows an elevated perspective view of one of the hermaphroditic electrical connectors 10 according to the invention, and FIGS. 4-6 show top plan, side elevational and end elevational views, respectively, of the connector. It can be seen that a row of female terminals 18 extend lengthwise of housing 14 generally parallel to a row of male terminals 20. FIG. 3 clearly shows how contact posts 26 of the male terminals project from the housing for insertion between contact arms 22 of female terminals 18 of an identically constructed, hermaphroditic connector.

FIGS. 3 and 4 show how terminal feet 34 of female terminals 18 and terminal feet 49 of male terminals 20 project laterally out of opposite sides of housing 14. FIGS. 5 and 6 show that a pair of mounting posts 16 depend from the housing for insertion into appropriate mounting holes in the printed circuit board. Lastly, a pair of generally S-shaped "fitting nails", generally designated 56, are mounted at opposite ends of housing 14. As is known in the art, each fitting nail includes a foot portion 58 for surface mounting to a solder pad on the respective circuit board to facilitate securing the connector to the board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A low profile hermaphroditic electrical connector mounted on a surface of a first printed circuit board and adapted to mate with an identical second hermaphroditic connector mounted on a surface of a second printed circuit board to electrically and mechanically couple the first printed circuit board to the second printed circuit board, each connector including:

a housing, a plurality of stamped female and male terminals held in said housing, each terminal having a surface mounting portion for electrically engaging the respective printed circuit board, a mating portion adapted to mate with the mating portion of the terminal of the opposite gender of the identical second hermaphroditic connector, and means for holding each of said terminals in said housing, the improvement comprising:

the mating portion of said female terminal including two opposed, spaced apart contact arms, said contact arms and a means for holding said female terminal both projecting from the surface mounting portion of said female terminal with the contact arms laterally adjacent the means for holding the female terminal; and the mating portion of said male terminal including a contact post adapted to be received between and make contact with the contact arms of the female terminal, said post and means for holding said male terminal both projecting from the surface mounting portion of said male terminal with the post laterally adjacent the means for holding said male terminal.

2. The low profile hermaphroditic electrical connector of claim 1 wherein the surface mounting portion of said female terminal comprises an elongated generally planar base having two opposed stamped edges, a first edge providing the surface mounting portion for electrically engaging the respective printed circuit board, and said contact arms and said means for holding said female terminal both projecting from a secondary opposed edge.

3. The low profile hermaphroditic electrical connector of claim 2 wherein said contact arms and said means for holding said female terminal are generally planar and coplanar with the base.

4. The low profile hermaphroditic electrical connector of claim 3 wherein said means for holding said female terminal comprises a mounting post generally parallel to said contact arms.

5. The low profile hermaphroditic electrical connector of claim 1 wherein the surface mounting portion of said male terminal comprises an elongated generally planar base having two opposed stamped edges, a first edge providing the surface mounting portion for electrically engaging the respective printed circuit board, and said contact post and said means for holding said male terminal both projecting from the opposite edge.

6. The low profile hermaphroditic electrical connector of claim 5 wherein said contact post and said means for holding said male terminal are generally planar and coplanar with the base.

7. The low profile hermaphroditic electrical connector of claim 6 wherein said means for holding said male terminal comprises a mounting post generally parallel to said contact post.

8. The low profile hermaphroditic electrical connector of claim 5 wherein the surface mounting portion of said female terminal comprises an elongated generally planar base having opposed stamped edges, one edge providing the surface mounting portion for electrically engaging the respective printed circuit board, and said contact arms and said means for holding said female terminal both projecting from the opposite edge.

9. The low profile hermaphroditic electrical connector of claim 8 wherein said contact arms and said means for holding said female terminal are generally planar and coplanar with the base.

10. The low profile hermaphroditic electrical connector of claim 9 wherein said means for holding said female terminal comprises a mounting post generally parallel to said contact arms.

11. The low profile hermaphroditic electrical connector of claim 1 wherein a lip projects from the contact post beneath a shoulder on the respective housing to resist lifting of the surface mounting portion of said male terminal off the respective printed circuit board during unmating of the connectors.

12. The low profile hermaphroditic electrical connector of claim 11 wherein said lip extends from a side of the post located furthest from said laterally adjacent means for holding said male terminal.

* * * * *